US012486578B2

(12) United States Patent
Tabak et al.

(10) Patent No.: US 12,486,578 B2
(45) Date of Patent: Dec. 2, 2025

(54) PROCESS FOR IMPROVING CHARACTERISTICS OF GALVANIZED SURFACES

(71) Applicant: BORCELIK CELIK SAN. TIC. A. S., Bursa (TR)

(72) Inventors: Derya Tabak, Bursa (TR); Aydin Ersoy, Bursa (HU); Mehmet Gul, Bursa (TR); Mehmet Koroglu, Bursa (TR)

(73) Assignee: BORCELIK CELIK SAN. TIC. A. S., Bursa (TR)

( * ) Notice: Subject to any disclaimer, the term of this patent is extended or adjusted under 35 U.S.C. 154(b) by 510 days.

(21) Appl. No.: 18/028,766

(22) PCT Filed: Apr. 8, 2021

(86) PCT No.: PCT/TR2021/050326
§ 371 (c)(1),
(2) Date: Mar. 28, 2023

(87) PCT Pub. No.: WO2022/081107
PCT Pub. Date: Apr. 21, 2022

(65) Prior Publication Data

US 2023/0332294 A1 Oct. 19, 2023

(30) Foreign Application Priority Data

Oct. 12, 2020 (TR) ..... 2020/16196

(51) Int. Cl.
*C23C 22/30* (2006.01)
*C23C 2/26* (2006.01)
(Continued)

(52) U.S. Cl.
CPC ..... *C23C 22/10* (2013.01); *C23C 2/26* (2013.01); *C23C 2222/10* (2013.01)

(58) Field of Classification Search
CPC ..... C23C 22/10; C23C 22/30; C23C 2222/10; C23C 2/26; C23C 2/40; B21B 2001/288;
(Continued)

(56) References Cited

U.S. PATENT DOCUMENTS

2010/0272991 A1 10/2010 Posco

FOREIGN PATENT DOCUMENTS

CN 102482753 B 8/2014
CN 111601911 B * 6/2022 ..... C23C 28/321
(Continued)

OTHER PUBLICATIONS

ASTM Designation: B117-11, Standard Practice for Operating Salt Spray (Fog) Apparatus, ASTM International, 2011.
(Continued)

*Primary Examiner* — Lois L Zheng
(74) *Attorney, Agent, or Firm* — Bayramoglu Law Offices LLC

(57) ABSTRACT

A method of surface treatments that provide additional characteristics to the surfaces of galvanized steel materials is provided. A chromate-free coating material is applied after texturing on the surface of the galvanizing steel material and obtaining the roughness values. The resulting galvanized steel material provides a stainless-steel alternative sheet materials with high corrosion resistance and anti-fingerprint characteristics.

20 Claims, 3 Drawing Sheets

(51) Int. Cl.
*C23C 2/40* (2006.01)
*C23C 22/10* (2006.01)

(58) Field of Classification Search
CPC ... B21B 2261/14; B21B 2275/04; C09D 1/00; C09D 5/08; C09D 5/1681
See application file for complete search history.

(56) References Cited

FOREIGN PATENT DOCUMENTS

| | | | |
|---|---|---|---|
| KR | 20140058201 | A | 5/2014 |
| WO | 2010047465 | A1 | 4/2010 |

OTHER PUBLICATIONS

ASTM Designation: G 102-89 (Reapproved 1999), Standard Practice for Calculation of Corrosion Rates and Related Information from Electrochemical Measurements, American Society for Testing and Materials, 1989, pp. 1-7.

* cited by examiner

PROCESS FOR IMPROVING CHARACTERISTICS OF GALVANIZED SURFACES

CROSS-REFERENCE TO RELATED APPLICATIONS

This application is a 371 national stage entry of International Application PCT/TR2021/050326 filed Apr. 8, 2021, and which claims the benefit of Turkish Application TR 2020/16196 filed Oct. 12, 2020, the entire contents of which are incorporated by reference herein.

TECHNICAL FIELD

The invention is related to a surface treatment that provides burr-free, dyeable, and coating characteristics in fewer steps for galvanized sheet materials expected to have a stainless-steel appearance, as well as providing additional characteristics such as anti-fingerprint and high corrosion resistance for the final product.

BACKGROUND

Surface coating processes have attracted great attention thanks to the economic and technical advantages they provided in the last century. The production of some products that can meet the needs of developing technology can only be performed by coating processes or they become economical in this way.

The coating process is performed to change the physical and chemical characteristics of a material surface. The processes that deal with the design of the material, including surface and base, and that can economically provide characteristics that cannot be achieved by both of them alone, are generally called surface treatments.

Before the coating materials used to have the desired characteristics of the final product are applied to the main steel sheet surfaces, the steel sheet materials must undergo certain pre-treatments. Preparation of the main metal surface is one of the most important factors in the success or failure of the coating process. The cleanness of the surface is even more important than the shape of the main metal surface. There are many surface conditions.

Surface shape (profile) type depends on the conditions that the coating will undergo and the equipment available to apply the coating. Generally accepted methods for surface preparation are the processes such as making cavities, coarse threading, sand-grain blasting, use of self-binding materials, stud placement, electrical connection, grinding and etching, work hardening on the surface.

With the advancement of technology and the industry, expectations from galvanized steel materials are increasing. Accordingly, steel materials are expected to have good additional mechanical characteristics such as friction coefficient, being a ready-to-dye surface, facilitating shaping, and high-temperature resistance, as well as increased corrosion resistance.

As known in the art, coating materials of various structures are applied to provide additional characteristics to galvanized sheet materials. Depending on the characteristics of the coating materials, the application processes of the sheet material also vary. For the coating materials to be applied to sheet materials, suitable surface conditions must be established.

In the relevant technical field, it is observed that during the application of coating materials to galvanized steel sheet materials, surface treatments are not performed as required and therefore coating materials with limited usage time are obtained. Also, it is known that the coating materials applied to galvanized sheet materials are insufficient in providing other desired mechanical characteristics in addition to corrosion resistance. In the present invention, it is envisaged that the production of steel sheet materials with superior characteristics will meet the innovation criteria in the relevant technical field using the realization of surface treatments with the arrangements made in the classical production lines and the coating and dying of the steel sheet materials by the stainless-steel appearance, which is the final product.

SUMMARY OF THE INVENTION

The present invention is related to surface treatments applied to galvanized sheet materials expected to have a stainless-steel appearance, to eliminate the above-mentioned disadvantages, and to bring new advantages to the relevant technical field.

An object of the invention is to provide a surface treatment that provides burr-free, dyeable, and coating characteristics for steel sheet materials with a stainless appearance in fewer steps, as well as providing additional characteristics such as anti-fingerprint and high corrosion resistance for the final product.

The present invention is related to surface treatments for sheet materials, to achieve all the purposes mentioned above and that will emerge from the detailed description below. Accordingly, the invention includes the following process steps that provide burr-free, dyeable, and coating properties for galvanized steel sheet materials that are expected to have a stainless-steel appearance, as well as providing anti-fingerprint and high corrosion resistance for the final product,

- Application of SPM process, which creates roughness between 2.90 Ra to 5 Ra using special SPM rollers texturized with certain parameters;
- Application of the sheet material that reaches the desired roughness values, the coating material that fixes the textured surface and does not contain chromate.

Thus, it is possible to obtain a stainless-steel alternative with a striped appearance, galvanized steel sheet, which provides dyeing and coating characteristics, as well as anti-fingerprint and high corrosion characteristics for the final product.

In the possible embodiment of the invention, a roughness of 2.90 Ra to 3.5 Ra is provided on the sheet material surfaces using the rollers. In this way, the desired roughness values can be obtained for the production of galvanized sheets with a stainless-steel alternative in a striped appearance.

The crown amount of the rollers used in the SPM process mentioned in the possible embodiment of the invention is between 0.02 mm to 0.08 mm crown. In this way, the desired roughness values are provided on the surfaces of galvanized sheet materials.

A possible embodiment of the invention is that the hardness of the rollers used in the SPM process is between 800 to 900 HLD values. Thus, it is possible for the rollers used in the SPM process to exhibit superior performance.

The possible embodiment of the invention is that the chromate-free coating material comprises chromium nitrate component at a value between 1% to 10% by weight; chromium phosphate component at a value between 1% to 10% by weight; methanol at a value between 1% to 10%;

ethanol at a value between 1% to 10%; phosphoric acid at a value between 1% to 10%; nitric acid compounds at a value between 1% to 10%. Thus, it is ensured that the striped surface appearance to be obtained at the end of the processes is fixed on the steel material surface.

A possible embodiment of the invention is that the coating material is coated on the sheet material at a value of 0.5 to 5 microns.

DETAILED DESCRIPTION OF THE INVENTION

Figure 1:
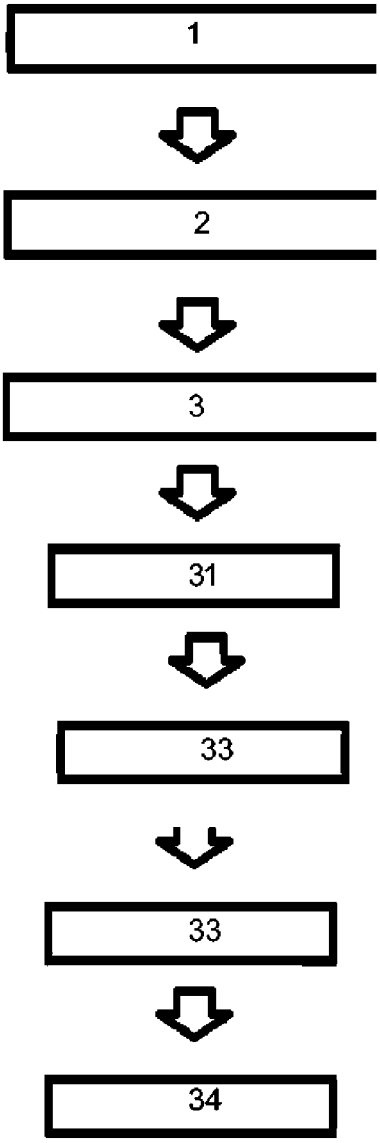
FIG. 1 shows the schematic form showing the process steps of the surface treatments applied for the steel sheets of the invention.
Figure 2:
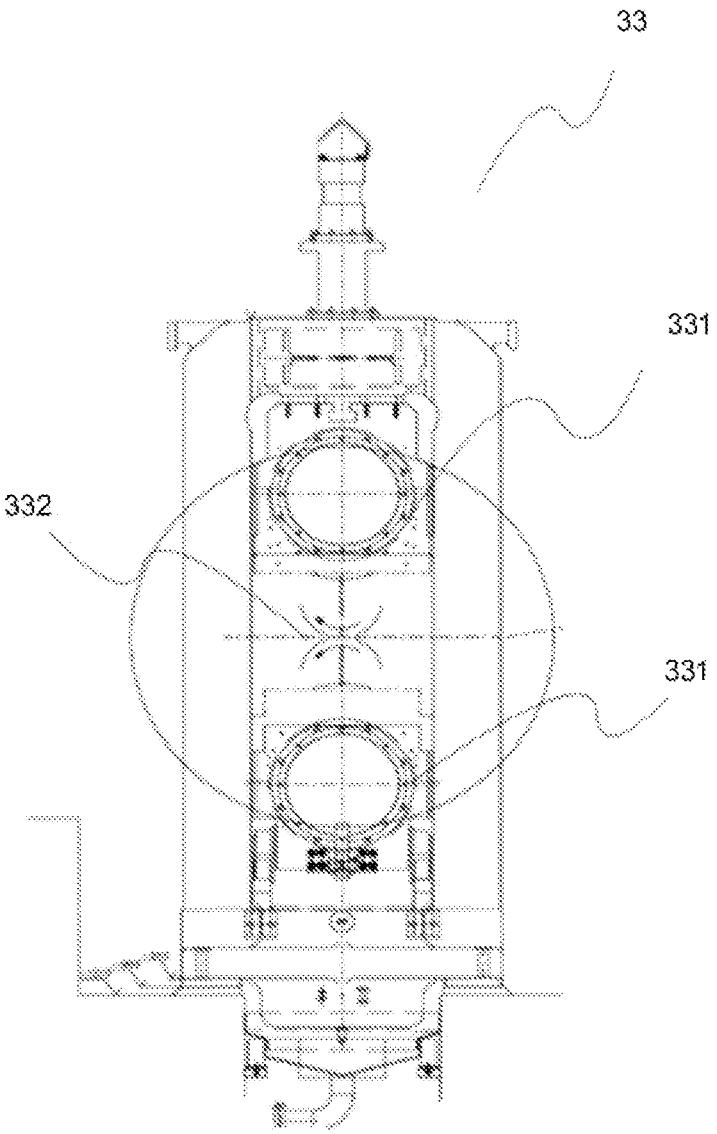
FIG. 2 shows the technical drawings of the SPM rollers where surface treatments for the steel sheets of the invention are carried out.
Figure 3:
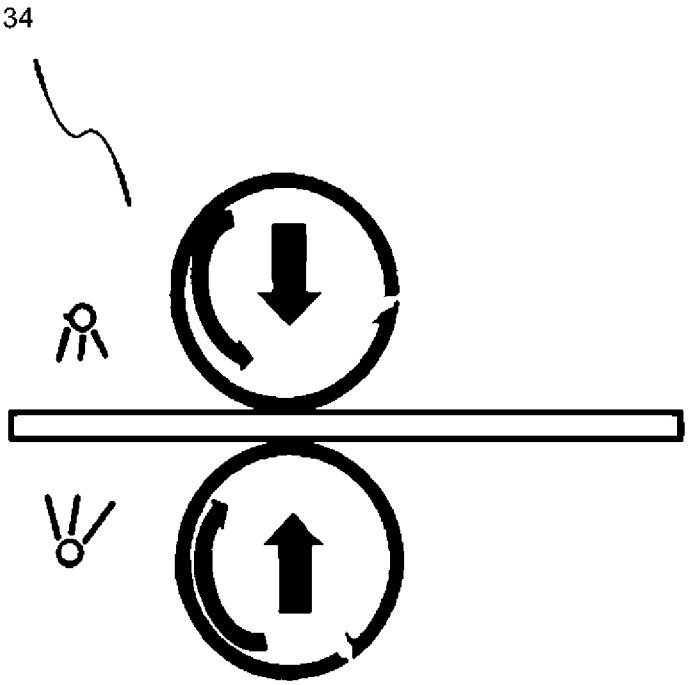
FIG. 3 shows a representative view of the coating material application line where the coating material is applied to the sheet material, which is another step of the surface treatments for the steel sheets of the invention.

Reference numbers given in FIGS. 1-3 are as follows: 1 Continuous Pickling Line; 2 Reversible Cold Rolling Line; 3 Continuous Galvanizing Line; 31 Annealing Unit; 32 Galvanizing Unit; 33 SPM Process Line; 331 SPM Rollers; 332 Section Where Galvanized Sheet Material Is Located; 34 Passivation Unit.

The subject of the invention is related to a surface treatment that provides burr-free, dyeable, and coating characteristics in fewer steps for galvanized sheet materials expected to have a stainless-steel appearance, as well as providing additional characteristics such as anti-fingerprint and high corrosion resistance to the final product obtained from galvanized steel material, and it is only explained with examples that do not have any limiting effect for a better understanding of the subject.

The innovative aspect of the invention is mainly related to surface treatments that provide additional characteristics to the surfaces of galvanized steel materials. Accordingly, there are some innovations in the invention in surface treatment processes to provide additional characteristics to the relevant technical field.

In the invention, firstly, galvanized steel is obtained. As is known in the art, the schematic view of the lines mentioned in FIG. 1 is given. Accordingly, the part indicated with reference number 1 is called the Continuous Pickling Line (1). In these lines, hot-rolled sheet material coming as raw material is placed in hydrochloric acid pools of certain concentrations and surface cleaning is performed.

The part indicated with reference number 2 in FIG. 1 is called the Reversible Cold Rolling Line (2). In this section, it is ensured that the sheet material, whose surface is cleaned, is reduced to the target thickness at low temperatures (room temperature).

In the preferred embodiment of the invention, in the production line called the Continuous Galvanizing Line (3), annealing, galvanizing, surface treatments, and coating material application processes can all be performed together. This production section, known as the production section where the coating material obtained in this way is applied to the sheet material, does not contain additional degreasing and cleaning processes as it is in the art. Also, the coating material can be applied to the sheet material at temperatures that can be considered low in the art. Unit production time ranges from 7.5 minutes to 20.8 minutes.

The sheet material coming to the Continuous Galvanizing Line (3) is firstly kept in the NOF (known as a nonoxidizing furnace in the art) section, which is the 1$^{st}$ section of the annealing unit (31) for surface cleaning at certain temperatures for certain periods. In the mentioned NOF section, surface cleaning processes are applied to the sheet material at temperatures of 620 to 760° C. Then, the annealing processes are applied to the sheet material at certain temperatures and times in the RTH (known as radiant tube heating) section of the Continuous Galvanizing Line (3). Annealing processes are applied to the sheet material at temperatures between 670 to 830° C. in the RTH section. After the application of temperature processes for a certain period, it is left to cool down and then the sheet material is immersed in the pot containing zinc in the Galvanizing Unit (32) at certain temperatures for galvanizing processes. Preferably, according to the characteristics of the product, zinc is applied to the sheet material at a value between 80 to 350 g. The temperature of the mentioned pot is between 455 to 480° C.

Surface treatments are applied to the galvanized sheet material in the skin pass mill process line (33) (referred to as SPM). Surface treatments, which is the innovative aspect of the invention, are carried out in the SPM process line (33). Some changes are made to the SPM rollers (331) that enable the application of the mentioned process. The SPM rollers (331) of the invention are turned into specially textured rollers together with the grinding processes for the production of galvanized sheets with high stainless-steel alternatives in striped appearance.

The desired surface appearance (rough striped appearance) from galvanized steels is created with SPM rollers (331). The stone scratches of the mentioned SPM rollers (331) must be deep and long to create roughness on the surface of steel materials.

SPM rollers (331) are ground by the curvature amount determined by the line. The said curvature amount is at a value between 0.02 mm and 0.08 mm crown. The preferred amount of curvature is 0.05 mm crown.

A 20 to 25-grained grinding wheel is used as the grinding material. Also, grinding material with a width of 100 mm and a diameter of 750 mm is used.

The SPM roller (331) to be ground is placed on the CNC grinding machine at the previously specified parameters, and the machine jaw adjustment and alignment are made according to its length. The parameters in the grinding process applied for obtaining special textured SPM rollers (331) are given in detail. Accordingly, while performing the grinding process, the chuck rotation speed is at a value between 20 to 40 rpm. The stone rotation speed in the grinding process is preferred to be at a value between 10 to 30 m/sec. The Z-axis feed rate of the grinding process is at a value between 900 and 1400 mm/min. After the grinding process applied with the mentioned parameters, it is possible to obtain SPM rollers (331) that provide the desired pattern and have roughness values.

The number of grinding process passes is at a value between 0.1 to 1.5.

SPM rollers (331), which are ground, have a roughness at a value of 2.90 Ra to 5 Ra as a result of the processes.

In the preferred embodiment, the roughness values of SPM rollers (331) are provided to be between 2.90 Ra and 3.50 Ra.

The obtained SPM roller (331) is chrome-coated if deemed appropriate, to increase its working characteristics and duration. In a preferred embodiment, it is desired that the chromium coating is at a value of 8 microns to 10 microns per unit point.

The SPM roller (331), to which the grinding process is applied in the parameters specified in the invention, is placed to be used in the SPM process (33) as indicated in FIG. 2. In the SPM process line (33), galvanized steel sheet materials, which are desired to have a striped and rough surface appearance, are processed with SPM rollers (331), which were previously subjected to the grinding process. Accordingly, the galvanized steel sheet material is placed in the section (332) in which the galvanized sheet material is located to be subjected to the SPM process (33). In this section, tempering processes are applied to the galvanized sheet material with SPM rollers (331) at a value between 100 to 180 rpm in speed. The pressure forces of the SPM rollers (331) are between 100 to 350 tons/m. Accordingly, the maximum elongation value of the galvanized steel sheet material applied by the SPM process (33) is 1.5%. Bending practices and balancing practices are important to achieve a uniform appearance across the width. The surface obtained is then controlled and necessary interventions are made by the feedback. In the SPM process line (33), the desired stripe-like rough surface appearance is achieved on the steel sheet material on which surface treatments are applied.

Another innovative aspect of the invention is related to the application of coating material in the passivation unit (34) to the galvanized steel materials, which have a stripe-like rough surface appearance obtained by the textured SPM rollers (331) suitable for the processes, to ensure that the said striped rough surface remains constant.

The galvanized sheet material, whose surface appearance is provided, is directed to the passivation unit (34). As shown in FIG. 3, in this application line, coating materials are applied to both surfaces of the sheet material. After the application of the SPM process (33), the coating material obtained in the invention is applied to the galvanized sheet material. The coating material is sprayed on the sheet material from the nozzles located in the passivation unit (34) of the Continuous Galvanizing Line (3). The nozzles mentioned here are positioned to coincide with the lower and upper surfaces of the sheet material. In one embodiment, the coating material is sprayed to the lower part of the galvanized sheet material using a lower nozzle while it is left on the upper part of the sheet material by the upper nozzles with gravity. The temperature value in this section is adjusted to a maximum of 40° C. Room temperature can be adjusted as the lowest temperature. As shown in FIG. 3, shafts are passed on the sheet material to which the coating material is applied to spread the coating material evenly.

In a possible embodiment of the invention, the said coating material comprises chromium nitrate component at a value between 1% to 10% by weight; chromium phosphate component at a value between 1% to 10% by weight; methanol at a value between 1% to 10%; ethanol at a value between 1% to 10%; phosphoric acid at a value between 1% to 10%; nitric acid compounds at a value between 1% to 10%. Thus, by coating galvanized surfaces in certain micron ranges, it is possible to obtain a sheet material with high-temperature resistance, which provides a significant increase in corrosion resistance, as well as fingerprint-free, dye-ready surface, facilitating shaping.

Preferably, by applying lacquer coating processes to the final product obtained, shaping and coloring processes are performed. As a result of the processes performed here, the stainless-steel alternative sheet materials with high corrosion resistance and anti-fingerprint characteristics are obtained.

Several tests are applied to the final product to evaluate its corrosion and mechanical characteristics. One of the two samples subjected to corrosion tests, the first sample (made according to ASTM B117 standard) had white rust formation in 300 hours, red rust formation in 2064 hours, while the second sample had white red formation in 320 hours, and red rust formation in for 1824 hours. In electrochemical corrosion tests performed according to ASTM G102 standard, the corrosion resistance value of the first sample is 80 kohm while the second sample is 100 kohm.

The scope of protection of the invention is specified in the attached claims and it cannot be limited to what is explained in this detailed description for the sake of example. A person skilled in the art can provide similar embodiments in the light of the above, without departing from the main theme of the invention.

What is claimed:

1. A method of surface treatment for galvanized sheet materials to provide a stainless-steel appearance, comprising the following steps:

applying a skin pass mill (SPM) process to a galvanized steel sheet material with textured SPM rollers having a crown of 0.02 mm to 0.08 mm, producing a desired roughness of between 2.90 μm Ra to 5 μm Ra on the galvanized steel sheet material;

applying a coating material that stabilizes the texture surface of the galvanized steel sheet material that reaches the desired roughness, wherein the coating material comprises chromium nitrate, chromium phosphate, methanol, ethanol, and nitric acid; and wherein the coating material does not comprise chromate.

2. The method of surface treatment according to claim 1, wherein the desired roughness created on the galvanized steel sheet material has a value between 2.90 Ra to 3.5 Ra.

3. The method of surface treatment according to claim 2, wherein the coating material is coated on the galvanized steel sheet material at a thickness value of 0.5 to 5 microns.

4. The method of surface treatment according to claim 2, wherein the coating material comprises chromium nitrate component at a value between 1% to 10% by weight; chromium phosphate component at a value between 1% to 10% by weight; methanol at a value between 1% to 10% by weight; ethanol at a value between 1% to 10% by weight; phosphoric acid at a value between 1% to 10% by weight; nitric acid at a value between 1% to 10% by weight.

5. The method of surface treatment according to claim 4, wherein the coating material is coated on the galvanized steel sheet material at a thickness value of 0.5 to 5 microns.

6. The method of surface treatment according to claim 1, wherein the hardness of the SPM rollers is between 800 to 900 HLD values.

7. The method of surface treatment according to claim 6, wherein the coating material is coated on the galvanized steel sheet material at a thickness value of 0.5 to 5 microns.

8. The method of surface treatment according to claim 6, wherein the coating material comprises chromium nitrate component at a value between 1% to 10% by weight; chromium phosphate component at a value between 1% to 10% by weight; methanol at a value between 1% to 10% by weight; ethanol at a value between 1% to 10% by weight; phosphoric acid at a value between 1% to 10% by weight; nitric acid at a value between 1% to 10% by weight.

9. The method of surface treatment according to claim 8, wherein the coating material is coated on the galvanized steel sheet material at a thickness value of 0.5 to 5 microns.

10. The method of surface treatment according to claim 1, wherein a rotation speed of the SPM rollers is between 100 and 180 rpm.

11. The method of surface treatment according to claim 10, wherein the coating material is coated on the galvanized steel sheet material at a thickness value of 0.5 to 5 microns.

12. The method of surface treatment according to claim 10, wherein the coating material comprises chromium nitrate component at a value between 1% to 10% by weight; chromium phosphate component at a value between 1% to 10% by weight; methanol at a value between 1% to 10% by weight; ethanol at a value between 1% to 10% by weight; phosphoric acid at a value between 1% to 10% by weight; nitric acid at a value between 1% to 10% by weight.

13. The method of surface treatment according to claim 12, wherein the coating material is coated on the galvanized steel sheet material at a thickness value of 0.5 to 5 microns.

14. The method of surface treatment according to claim 1, wherein pressure forces of the SPM rollers used in applying the SPM process are between 100 to 350 tons/m.

15. The method of surface treatment according to claim 14, wherein the coating material is coated on the galvanized steel sheet material at a thickness value of 0.5 to 5 microns.

16. The method of surface treatment according to claim 14, wherein the coating material comprises chromium nitrate component at a value between 1% to 10% by weight; chromium phosphate component at a value between 1% to 10% by weight; methanol at a value between 1% to 10% by weight; ethanol at a value between 1% to 10% by weight; phosphoric acid at a value between 1% to 10% by weight; nitric acid at a value between 1% to 10% by weight.

17. The method of surface treatment according to claim 16, wherein the coating material is coated on the galvanized steel sheet material at a thickness value of 0.5 to 5 microns.

18. The method of surface treatment according to claim 1, wherein the coating material comprises chromium nitrate component at a value between 1% to 10% by weight; chromium phosphate component at a value between 1% to 10% by weight; methanol at a value between 1% to 10% by weight; ethanol at a value between 1% to 10% by weight; phosphoric acid at a value between 1% to 10% by weight; nitric acid at a value between 1% to 10% by weight.

19. The method of surface treatment according to claim 18, wherein the coating material is coated on the galvanized steel sheet material at a thickness value of 0.5 to 5 microns.

20. The method of surface treatment according to claim 1, wherein the coating material is coated on the galvanized steel sheet material at a thickness value of 0.5 to 5 microns.

* * * * *